US007467756B2

(12) United States Patent
Juhlin

(10) Patent No.: US 7,467,756 B2
(45) Date of Patent: Dec. 23, 2008

(54) BOWL LINER MOVEMENT DETECTION METHOD AND APPARATUS

(75) Inventor: Jon Juhlin, Pleasant Hill, OR (US)

(73) Assignee: Johnson Crushers International, Eugene, OR (US)

( * ) Notice: Subject to any disclaimer, the term of this patent is extended or adjusted under 35 U.S.C. 154(b) by 114 days.

(21) Appl. No.: 11/401,531

(22) Filed: Apr. 10, 2006

(65) Prior Publication Data

US 2007/0235572 A1 Oct. 11, 2007

(51) Int. Cl.
*B02C 25/00* (2006.01)

(52) U.S. Cl. ..... 241/36; 241/101.3; 241/207

(58) Field of Classification Search ..... 241/33–37, 241/207–216, 101.3
See application file for complete search history.

(56) References Cited

U.S. PATENT DOCUMENTS 3,436,654 A * 4/1969 Thiele et al. ..... 324/662
4,251,035 A * 2/1981 Chatwin et al. ..... 241/37
4,810,964 A * 3/1989 Granberg et al. ..... 324/207.18
4,820,980 A * 4/1989 Dodson-Edgars ..... 324/207.24
5,694,338 A * 12/1997 Inomata et al. ..... 702/170

* cited by examiner

*Primary Examiner*—Mark Rosenbaum
(74) *Attorney, Agent, or Firm*—Schwabe, Williamson & Wyatt, P.C.

(57) ABSTRACT

A rock crusher liner movement detector is provided, wherein the detector is coupled to a crushing component and a liner such that the detector may detect a relative movement between the crushing component and the line.

16 Claims, 2 Drawing Sheets

BOWL LINER MOVEMENT DETECTION METHOD AND APPARATUS

FIELD OF THE INVENTION

Embodiments of the present invention relate to gyratory cone crushers, and more particularly to a method and apparatus for detecting movement of a liner material relative to a cone crusher component.

BACKGROUND

Gyratory cone crushers are particularly well suited for crushing rock and other materials. Such crushers typically have a base frame that includes a cone-shaped crushing head, which may be generally referred to as a cone assembly. The cone assembly may be oriented upward and adapted for gyratory motion. A bowl may be positioned to generally encompass the cone crushing head, such that rock is crushed between the bowl and the cone crushing head. Because these surfaces take a significant amount of abuse, both the crushing head and the bowl can be fitted with replaceable liners, which are made of a material that is well suited to withstand the rigors of rock crushing. Typically the liner on the cone crushing head is referred to as the "mantle" and the liner in the bowl is referred to as the "bowl liner."

Movement or separation of the liners from either the bowl or crushing head can cause significant problems, including, but not limited to, premature wearing of the liner, significant damage to the crusher components, component imbalance and/or inconsistent product production. Further, failure of the liners and damage to the components can lead to significant downtime. Accordingly, detecting even the smallest movement of the liner relative to the crushing component may help prevent many of the aforementioned problems.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

Figure 1:
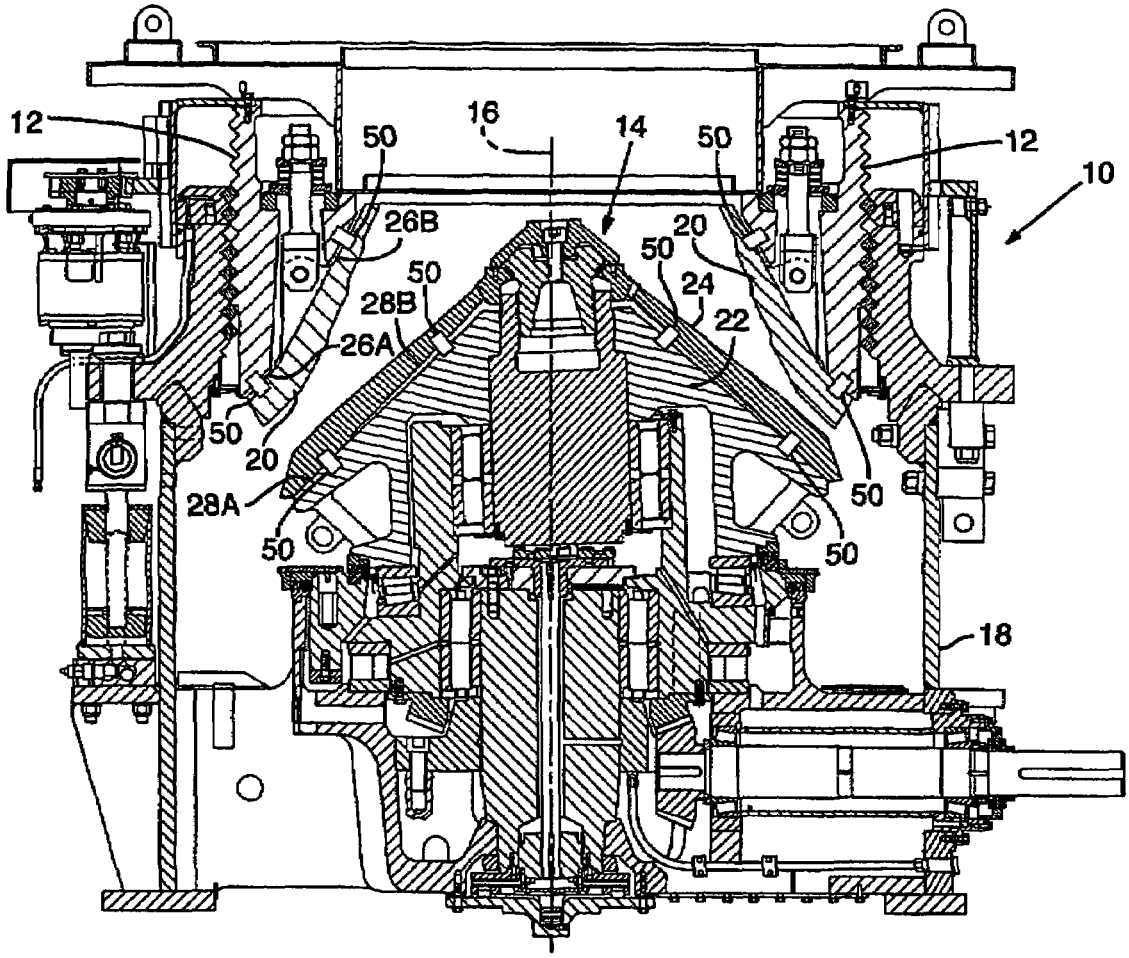
FIG. 1 illustrates a cross-sectional view of an example gyratory cone-type crusher in accordance with an embodiment of the present invention.

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

The following description may include terms such as inner, outer, under, between, upward, downward, outward, inward, and the like, which are used for descriptive purposes only and are not to be construed as limiting. That is, these terms are terms that are relative only to a point of reference and are not meant to be interpreted as limitations but are, instead, included in the following description to facilitate understanding of the various aspects of the invention.

The phrase "in one embodiment" may be used repeatedly. The phrase generally does not refer to the same embodiment; however, it may. The terms "comprising," "having," and "including" are synonymous, unless the context dictates otherwise.

The phrase "A/B" means "A or B." The phrase "A and/or B" means "(A), (B), or (A and B)." The phrase "at least one of A, B and C" means "(A), (B), (C), (A and B), (A and C), (B and C) or (A, B and C)." The phrase "(A) B" means "(B) or (A B)"; that is, A is optional.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

Embodiments of the present invention may be adapted to detect an occurrence of a relative movement between the liner and a crushing component. Such movement may be, for example, sliding movement, shearing movement, and/or separating movement. The term liner, however, may be used here to refer to any lining material adjacent to, coupled to, or affixed to a crushing component including but not limited to bowl liners and mantles. Embodiments of the present invention may include an indicator to indicate a movement or separation of the liner and the rock crusher component. In one embodiment the rock crushing component may be the bowl. In another embodiment the rock crushing component may be the cone. In another embodiment the rock crushing component may be both.

A variety of cone crusher designs are known and currently used. One common feature among the designs is the use of a replaceable bowl liner. Accordingly, bowl liner movement detection apparatuses in accordance with embodiments of the present invention may be used with a variety of cone crusher designs, either an original equipment manufacturer product or an after-market or retrofit application with replacement bowl liners.

FIG. 1 illustrates a cross-sectional view of an example gyratory cone-type crusher 10 in accordance with an embodiment of the present invention. The crusher 10 includes a bowl 12, which may be disposed in an inverted position generally over a cone-shaped crushing head, or cone assembly 14, and centered on a vertical crusher axis 16. Cone assembly 14 may be operationally coupled to a base frame 18 of crusher 10. The bowl 12, and the cone assembly 14, may be adapted as complementary crushing members.

The first crushing member, or the bowl 12, may have a first liner or bowl liner 20 arranged thereon. The second crushing member, or the cone assembly 14, may include a cone 22, and a second liner or mantle 24 arranged on the cone 22. The bowl liner 20 on the bowl 12 and the mantle 24 on the cone 22, may then act as interface surfaces for the rock or material being crushed. Accordingly, bowl liner 20 and mantle 24 are sacrificial wear parts that may be made of special materials particularly suited for crushing of rock and other materials. In one embodiment, a steel richly alloyed with, for example, manganese, may be used as the base material for bowl liner 20 and mantle 24. Other materials may be used.

Sliding and/or separation movement of the liner 20, or the mantle 24, from the respective crushing components, i.e., the bowl 12, or cone 22, may cause and/or precipitate the aforementioned problems. Such movement can be dangerous to operators and precipitate expensive repairs. Early indication of movement or separation of the liner 20 and/or the mantle 24, may prove advantageous as proper maintenance, and/or replacement may then be conducted in a timely manner.

The bowl liner 20 may be shaped to generally mimic or be substantially similar to that of the conical shape of the inner portion of bowl 12, such bowl liner 20 may be configured to be in close engagement at points along the conical inner portion of the bowl, which may be generally illustrated by example points 26A and 26B. In some embodiments in accordance with the present invention, the bowl liner may be in direct contact with the conical portion of the bowl, as shown, for example, at 26A, or may be spaced apart from the bowl 12 a predetermined distance, as shown, for example, at 26B, or a combination thereof. Any space between the bowl liner 20 and bowl 12 may be filled with a material, such as an epoxy resin, which may provide support for the bowl liner during operation and may help to resist bowl liner deformation.

Similarly, the mantle 24 may be configured to be in close engagement at points along the conical outer portion of the cone 22, which may be generally illustrated by example points 28A and 28B. In some embodiments in accordance with the present invention, the mantle 24 may be in direct contact with cone 22, as shown, for example, at 28A, or may be spaced apart from the cone 22 a predetermined distance, as shown for example at 28B, or a combination thereof. Any space between the mantle 24 and cone 22 may be filled with a material, such as an epoxy resin, which may provide support for the bowl liner during operation and to help resist bowl liner deformation.

Because the cone assembly 14 gyrates and crushes material between the mantle 24 and stationary bowl liner 20, there is a tendency for the bowl liner 20 to want to rotate and/or separate within the bowl 12, and/or to otherwise move relative the bowl 12. The mantle 24 may also be prone to rotate, separate, or otherwise move relative the cone 22.

One embodiment of the invention provides one or more movement detectors 50, illustrated schematically as rectangles in FIG. 1, which may be adapted to detect when there is a determined amount of relative movement between the bowl and the liners and the crushing components by detecting a change in the continuity of a circuit that may be caused by relative movement. The detectors 50 may be located, for example, at various junctions between the crushing members 12/14 and the respective liners 20/24. The crusher 10 illustrates as an example eight movement detectors 50, although any number may be used in accordance with embodiments of the invention. The detectors 50 may be adapted to send a signal to a controller, which may, for example, initiate an alarm (visual or audible) and/or cause the crusher 10 to stop operations.

Figure 2A:
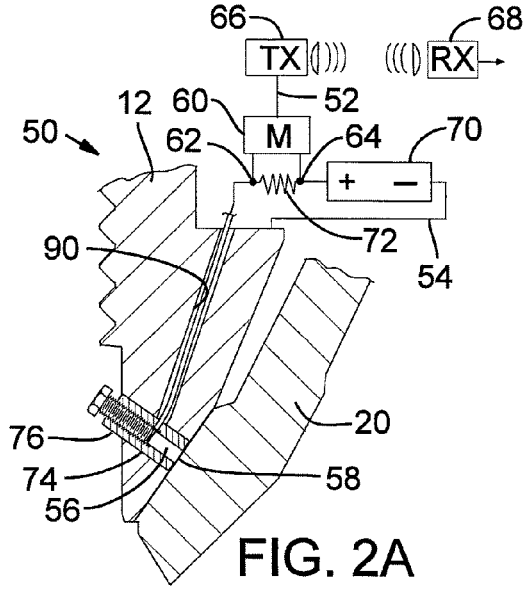
FIGS. 2A and 2B illustrate cross-sectional views of a bowl liner movement detector in accordance with an embodiment of the present invention.
Figure 2B:
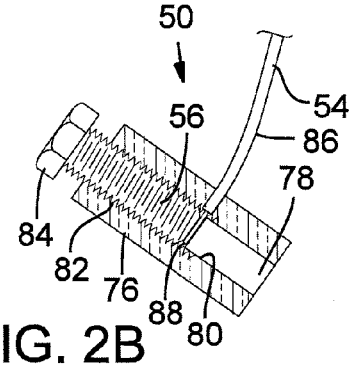

FIG. 2A illustrates a cross-sectional view of one embodiment of a liner movement detector in accordance with the invention. FIG. 2B is a blown up cross-sectional view of a portion of the detector of FIG. 2A. A liner, such as bowl liner 20 may be adapted to be in contact with, or in predetermined proximity to, a crushing member, for example, a bowl 12. A movement detector 50 adapted to detect movement between the bowl liner 20 and the bowl 12, and may include a communication line 52 adapted to communicate the occurrence of any detected movement.

The detector 50 may include one or more components adapted to experience a change in one or more physical properties that may be adapted to send a communication signal to indicate movement. In the embodiment illustrated, an electric circuit 54 may be adapted such that a current or voltage that may change if the liner 20 moves relative the bowl 12. The detector 50 may include a first contact 56 fixed relative the bowl and a second contact 58 fixed relative the liner 20. A comparator 60 may be adapted to detect a change in, for example, a voltage across points 62 and 64 in the circuit 54 if the first contact 56 separates from a second contact 58. The comparator 60 may then send a signal via the communication line 52 to a transmitter 66 which may be adapted to send a signal to a receiver 68.

The second contact 58, which in the currently described embodiment may be the liner 20 itself, may be held at a given voltage, for example at ground. In another embodiment the second contact 58 may be an added component, and may be held at a specified voltage, including a ground voltage, or may be part of a circuit completed when the first and second contacts 56/58 make contact. The circuit 54 may include a voltage source 70 and other circuit components to effect functionality as represented schematically with a resistor symbol 72.

As discussed, the communication line 52 may be configured to transmit a signal to indicate the occurrence of a movement of the liner 20 relative the bowl 12 beyond a predetermined or specified amount. The signal may be read by, for example, an operator or received by a controller adapted to generate an action. Such action may include stopping the crusher 10, or adjusting its speed, or in one embodiment may trigger an alarm. The signal may be transferred via a wireless connection, which may be effected by a transmitter 66 and a receiver 68. Other embodiments may include a direct, or wired, connection between the movement detector 50 and the signal receiver.

In one embodiment, the bowl 12 may include a first bore 74 through a portion thereof. An insert 76 may be positioned in bore 74, and further be adapted to house first contact 56. In one embodiment, the first contact 56 may include a contact 78 positioned in the insert 76. The contact 78 may be, for example, press fit into a first portion 80 of the insert 76. A second portion 82 of the insert 76 may be a threaded portion 82. A threaded member, for example, a screw 84 may be threaded into the threaded portion 82.

The circuit 54 may include a wire 86 having a conducting portion, for example an exposed wire 88 disposed between the contact 78 and the screw 84. The screw 84 may be tightened to clamp the exposed wire 88 against the contact 78, and to urge the contact end 78 against the liner 20. A second bore 90 may also be defined in the bowl 12, and may be disposed to house at least a portion of the wire 86. In another embodiment, a transmission wire may be coupled to the screw 84 at a point outside of the bowl 12.

Figure 3:
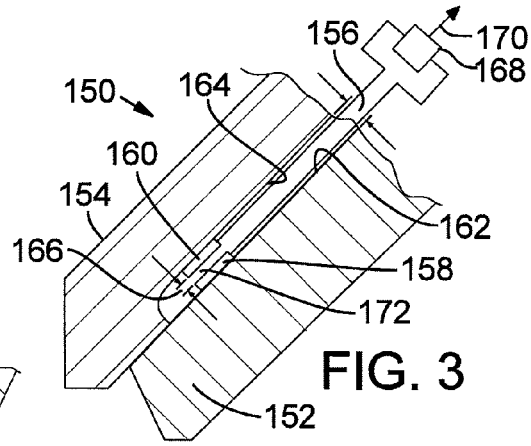
FIG. 3 illustrates a cross-sectional view of a bowl liner movement detector in accordance with an embodiment of the present invention.

FIG. 3 illustrates a cross-sectional view of a bowl liner movement detector 150 in accordance with one embodiment of the present invention. The detector 150 may be adapted to monitor movement between a crushing element 152 and a liner 154. In the area of detector 150, the crushing element 152 and the liner 154 may be spaced a predetermined distance 156 apart when in an operational arrangement. A first plate 158 and a second plate 160 may be disposed on respective facing surfaces 162 and 164 of the crushing element 152 and the liner 154, and may be adapted to hold a charge as a capacitor.

The capacitance of the two plates 158/160 may be dependent on a distance 166 between the plates, which in turn depends on the distance 156 between the crushing element 152 and the liner 154. The capacitance may be measured by a comparator 168. A change in capacitance beyond a predetermined amount may be communicated by communication line 170. In one embodiment the communication line 170 may be adapted to function similar to communication line 52 described in reference to the embodiment shown in FIGS. 2A and 2B. A space 166 between the plates 158/160 may be filled with a suitable material 172, which may be a dielectric material, including air.

Figure 4A:
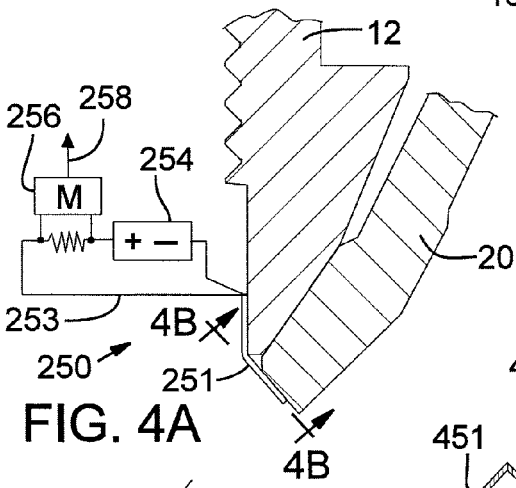
FIGS. 4A and 4B illustrate cross-sectional views of a bowl liner movement detector in accordance with an embodiment of the present invention.
Figure 4B:
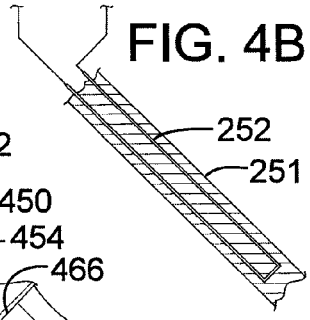

FIG. 4A is a cross-sectional view of a detector in accordance with one embodiment of the invention. FIG. 4B is a cross-sectional view taken at the line 4B-4B of FIG. 4A. A detector 250 may include a detector body 251 adapted to carry a conductor 252, and may be coupled with a surface of a bowl 12 and a liner 20. The detector body 251 and consequently the conductor 252 may be damaged, for example, it may stretch, expand, or break with relative movement of the liner 20 to the bowl 12 beyond a predetermined amount.

The conductor 252 may be a part of a circuit 253 which may include a current or voltage source 254 adapted to cause voltage potential or cause a current to run through the conductor 252 embedded in the detector body 251. In one embodiment, a change in the length of, or a break in, the detector body 251, for example, may change the resistance of the conductor 252 thereby changing the amount of current flowing through the circuit 253 which may be detected by a comparator 256. If a change of current beyond a predetermined amount is determined by the comparator 256 a signal may be sent via communication line 258 thereby indicating a movement of the liner beyond a predetermined amount.

In one embodiment the detector body 251 may be a disposable, and replaceable, detector body adapted to tear or otherwise deform and thereby break the circuit 253 and indicating a movement of the liner 20 relative to the bowl 12 beyond a predetermined amount.

Figure 5:
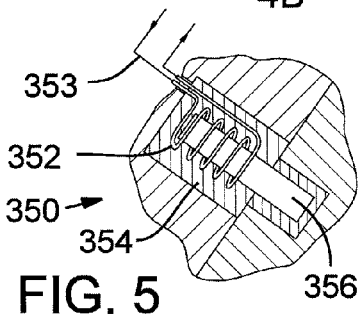
FIG. 5 illustrates a cross-sectional view of a bowl liner movement detector in accordance with an embodiment of the present invention.

FIG. 5 is a partial cross-sectional view of a detector 350 in accordance with one embodiment of the invention. A coil 352 may be adapted to be part of a circuit 353 (part of which is illustrated here) and may be disposed within a detector body 354. The detector body 354 may be embedded in one of a crushing member or a liner. A core 356 may be adapted to be secured relative to the other of a crushing member and a liner. Upon movement of one or the other of the crushing member and the liner, the core 356 may move within the coil 352 thereby changing an inductance of the circuit 353. An inductance change beyond a predetermined amount may be detected by an inductance sensor (not shown) and may effect a signal being sent thereby indicating a movement of the liner relative the crushing member beyond a predetermined amount.

Figure 6:
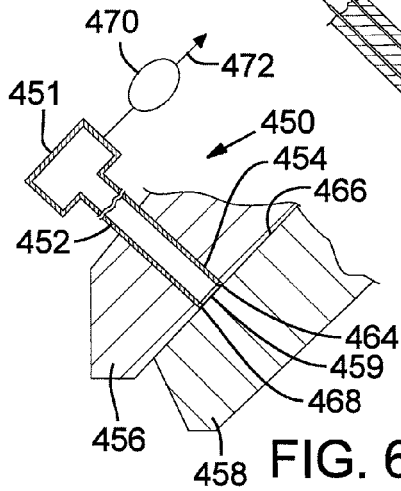
FIG. 6 illustrates a cross-sectional view of a bowl liner movement detector in accordance with an embodiment of the present invention.

FIG. 6 illustrates a detector 450 according to one embodiment of the invention. A pressurized vessel 451 may be fixed relative to one of the crushing member and the liner, and may be disposed within a bore 454 defined within one of a crushing member 456 or a liner 458. In one embodiment the pressurized vessel may be a tube or pressurized chamber 452. The tube 452 may define an opening 459 adapted to be closed by the other of the crushing member 456 and the liner 458. An end 464 of the tube 452 may be adapted to seat on a surface 466 of, for example, the liner 458. A gasket 468 may be positioned on the end 464 of the tube 452 which may provide a better seal between the tube end 464 and the surface 466 of the liner 458.

The pressurized vessel 451 may be adapted to be opened upon a relative movement between the crushing member 456 and the liner 458 reducing the pressure. In one embodiment, the pressurized vessel 451 may be under a negative pressure, i.e., a vacuum pressure, which may increase upon being opened by a relative movement between the crushing member 456 and the liner 458. A pressure detector 470 may be adapted to detect a change of pressure in the pressurized vessel 451 and to communicate the change of pressure as the occurrence of movement via communication line 472.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A gyratory cone crusher comprising:

cooperative crushing members adapted to crush rock material therebetween;

a liner secured to and generally forming a facing surface of at least one of the crushing members and against which the rock material is crushed, said liner having an opposing inner surface in fixed relation to said at least one of the crushing members to form engaging interfacings intended to remain in fixed relation throughout the operation of the crushing member and is, however, subjected to a force during crushing operation that urges undesired and harmful liner movement relative to the said at least one crushing member;

a detector embedded in at least one of the liner and said at least one crushing member at a position of said engaging interfacings, which detector is configured to detect an occurrence of any such relative movement between the crushing member and the liner; and said detector adapted to generate a signal, and said detector responsive to any such occurrence of movement for generating the signal to indicate said movement and a need to repair the securerment of the liner to the said at least one crushing member.

2. The cone crusher of claim 1, wherein the detector includes a first electrical component secured to the at least one of said crushing members and a second electrical component secured to the liner therefore, and wherein movement of the first electrical component relative to the second electrical component causes the signal to be generated indicating the occurrence of relative movement.

3. The cone crusher of claim 2, wherein the first electrical component is a first contact and the second electrical component is a second contact adapted to complete a circuit when contacting and to break the circuit when not contacting.

4. The cone crusher of claim 3, wherein the detector has a detector body adapted to house the first contact, a conductor, and a clamping member adapted to engage the detector body to clamp the conductor between the first contact and the clamping member and to push the first contact against the second contact.

5. The cone crusher of claim 4, wherein the second contact is one of the crushing member and the liner therefore.

6. The cone crusher of claim 2, wherein the first electrical component is a first capacitance element and the second electrical component is a second capacitance element defining a capacitor adapted to have a first capacitance value when in a first relative position and to have a second capacitance value when in a second relative position, a capacitance sensor adapted to sense a change in capacitance indicating that the liner has moved relative the crushing member.

7. The cone crusher of claim 2, wherein the first electrical component is a first inductance element and the second electrical component is a second inductance element positioned relative to the first inductance element and having a first inductance, an inductance sensor adapted to sense a change in first inductance when the second inductance element moves relative to the first inductance element caused by relative movement between the crushing member and the liner.

8. The cone crusher of claim 1, wherein the detector includes a detector body adapted to couple to both the at least one crushing member and the liner, a conductor in the detector body connected to a circuit and adapted to be monitored for a change in an electrical property, the detector body disposed such that a movement of the liner relative to the crushing member will alter the detector body causing a change in the electrical property.

9. The cone crusher of claim 8, wherein the electrical property is selected from a group consisting of current, resistance, capacitance, inductance and/or voltage.

10. The cone crusher of claim 1, wherein the detector includes a circuit including a coil connected to one of the said at least one crushing member and the liner therefore, and a core connected to the other of the said at least one crushing member and the liner therefore and positioned inside the coil, the detector adapted to sense the occurrence of relative movement due to a change in the circuit.

11. The cone crusher of claim 1, wherein the detector includes:

a pressurized vessel fixed relative to one of the said one crushing member and the liner and having an opening adapted to be closed by the other of the said one crushing member and the liner, the pressurized vessel adapted to open upon a relative movement between the crushing member and the liner; and a pressure detector adapted to detect a change of pressure in the pressurized vessel and to communicate the change of pressure as the occurrence of relative movement.

12. The cone crusher of claim 1, wherein the said one of the crushing members is a bowl of the cone crusher and the detector is disposed to detect movement between the bowl and the liner therefore.

13. The cone crusher of claim 1, wherein the signal generated is to either trigger an alarm or stop the cone crusher.

14. The cone crusher of claim 1, wherein the detector is adapted to detect a relative movement between the crushing member and the liner beyond a predetermined amount.

15. A cone crusher comprising:

a crushing member adapted to crush material;

a liner secured to the crushing member; and a detector configured to detect an occurrence of relative movement between the crushing member and the liner, said detector including a first electrical component secured to the crushing member and a second electrical component secured to the liner, and wherein movement of the first electrical component relative to the second electrical component causes a signal to be generated indicating the occurrence of relative movement, and wherein the first electrical component is a first inductance element and the second electrical component is a second inductance element positioned relative, to the first inductance element and having a first inductance, an inductance sensor adapted to sense a change in first inductance When the second inductance element moves relative to the first inductance element caused by relative movement between the crushing member and the liner.

16. A cone crusher comprising:

a crushing member adapted to crush material;

a liner secured to the crushing member; and a detector configured to detect an occurrence of relative movement between the crushing member and the liner, said detector including a pressurized vessel fixed relative to one of the crushing member and the liner and having an opening adapted to be closed by the other of the crushing member and the liner, the pressurized vessel adapted to open upon a relative movement between the crushing member and the liner; and a pressure detector adapted to detect a change of pressure in the pressurized vessel and to communicate the change of pressure as the occurrence of relative movement.

* * * * *